United States Patent [19]

Kajita et al.

[11] 4,129,985

[45] Dec. 19, 1978

[54] COMBUSTOR DEVICE OF GAS TURBINE ENGINE

[75] Inventors: Shinichi Kajita, Kobe; Kenji Mori, Ashiya; Junichi Kitajima, Minoo, all of Japan

[73] Assignee: Kawasaki Jukogyo Kabushiki Kaisha, Kobe, Japan

[21] Appl. No.: 739,863

[22] Filed: Nov. 9, 1976

[30] Foreign Application Priority Data

Nov. 17, 1975 [JP] Japan ..... 50/156614[U]
May 8, 1976 [JP] Japan ..... 51/52530

[51] Int. Cl.[2] ..... F02C 7/18
[52] U.S. Cl. ..... 60/39.37; 60/39.65
[58] Field of Search ..... 60/39.65, 39.66, 39.36, 60/39.37

[56] References Cited

U.S. PATENT DOCUMENTS

| | | | |
|---|---|---|---|
| 3,019,606 | 2/1962 | Franz | 60/39.36 |
| 3,088,279 | 5/1963 | Diedrich | 60/39.65 |
| 3,650,106 | 3/1972 | Guillot | 60/39.65 |
| 3,754,393 | 8/1973 | Handa | 60/39.65 |

FOREIGN PATENT DOCUMENTS

| | | | |
|---|---|---|---|
| 150203 | 5/1955 | Sweden | 60/39.65 |
| 704468 | 2/1954 | United Kingdom | 60/39.65 |
| 947134 | 1/1964 | United Kingdom | 60/39.65 |

*Primary Examiner*—Robert E. Garrett
*Attorney, Agent, or Firm*—Haseltine, Lake & Waters

[57] ABSTRACT

A combustor device of a gas turbine engine, which combustor device is supplied with compressed air from a compressor and delivers combustion gas to a turbine, comprises an outer casing and an inner casing defining therein a combustion chamber and forming between the outer and inner casings an annular passage for the intake of the compressed air, a swirler opening being provided at the innermost end of the inner casing for taking the compressed air into the combustion chamber. Swirling motion of the compressed air around the inlet of the swirler opening, which causes static pressure drop at the swirler opening inlet and resultant undesirable combustion, is effectively prevented by providing swirl preventing vanes between the inner and outer casings. When the swirl preventing vanes are provided near the swirler opening, guide vanes may be provided near the upstream end of the annular passage to intentionally impart swirling motion to the compressed air to prevent non-uniform distribution of the supplied compressed air.

8 Claims, 11 Drawing Figures

Fig. 3
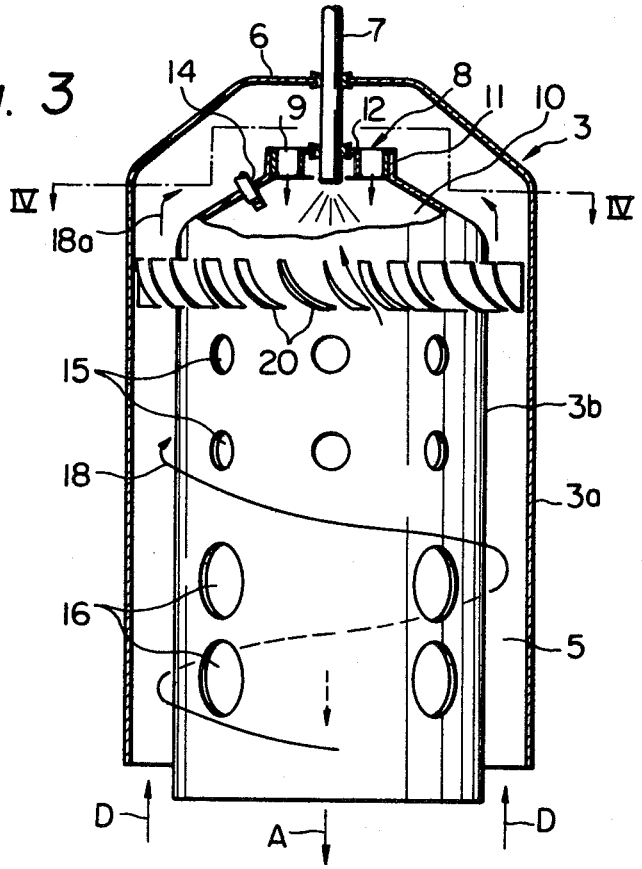
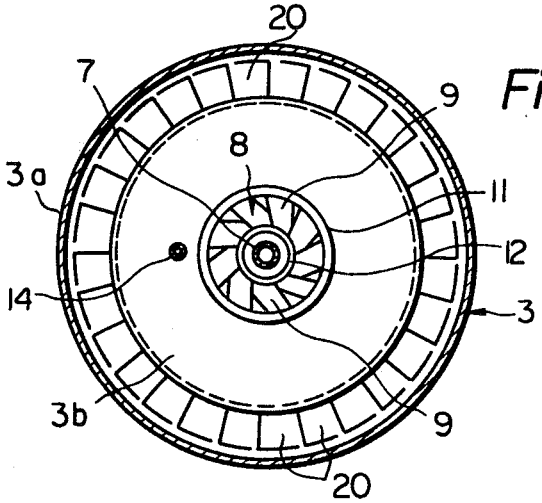
Fig. 4

Fig. 5
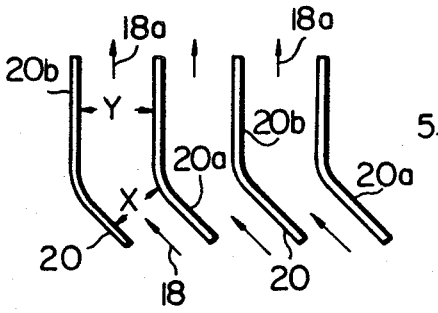
Fig. 6
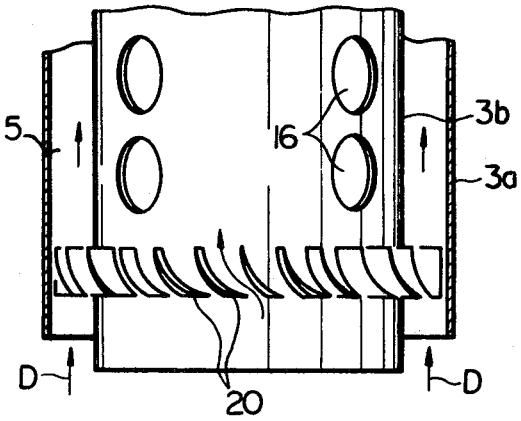
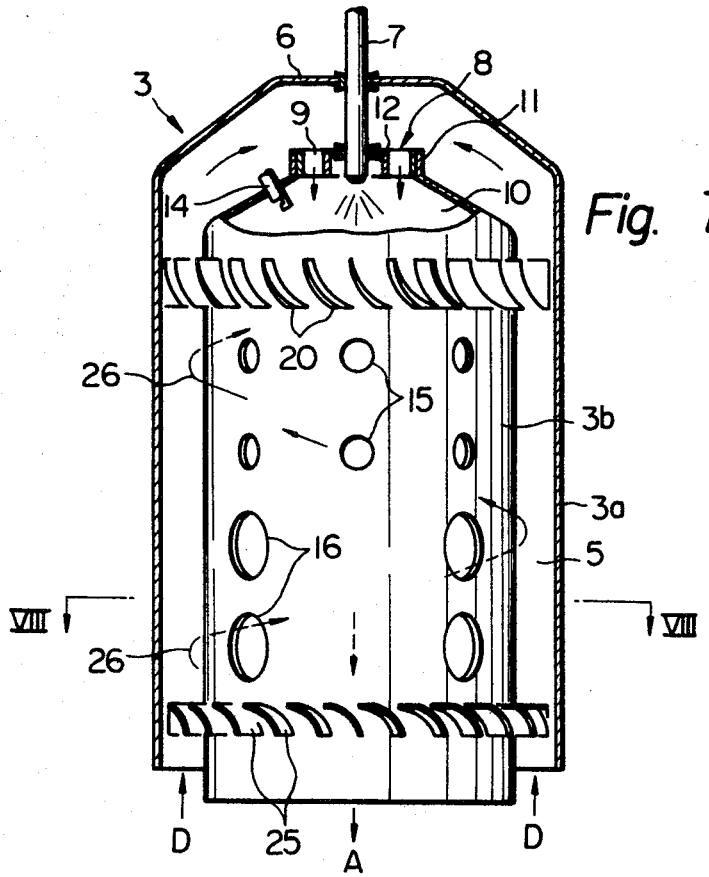
Fig. 7

Fig. 8
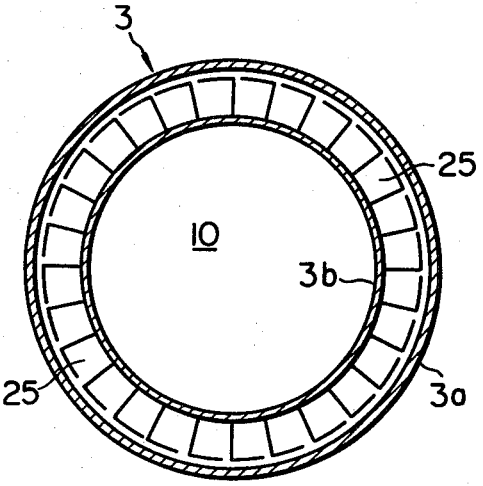
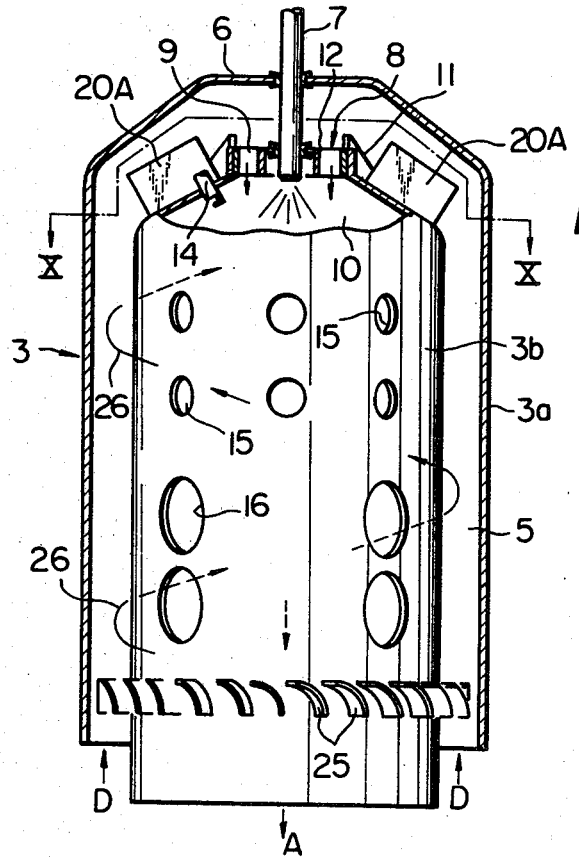
Fig. 9

COMBUSTOR DEVICE OF GAS TURBINE ENGINE

BACKGROUND OF THE INVENTION

Field of the Invention

This invention relates to gas turbine engines and more particularly to a combustor device for a gas turbine engine.

Prior Art

As is well known in the art, a gas turbine engine comprises a compressor, a combustor for taking therein compressed air discharged from the compressor, and a turbine driven by combustion gas supplied from the combustor. In small gas turbine engines, the combustor is usually of a so-called tangential can type which comprises a cylindrical outer casing having a closed axial end, a cylindrical inner casing coaxially disposed within the outer casing to define between the outer and inner casings an annular passage for taking therein the compressed air from the compressor. The inner casing defines therein a combustion chamber and has in one axial end thereof facing the closed axial end of the outer casing a swirler opening through which the compressed air taken in the annular passage flows into the combustion chamber after being imparted swirling motion by swirler vanes in the swirler opening for ensuring optimum mixing of the air and fuel injected into the combustion chamber as well as flame holding.

In the combustor of the above stated type, the compressed air from the compressor often enters the annular passage with swirling motion because of tangential velocity components of the compressed air due to the rotation of the compressor blades and because of off-center or offset disposition of the combustor with respect to the turbine scroll, which disposition cannot always be avoided for reasons of design. When the swirling motion of the compressed air is strong at the intake end of the annular passage, it continues to exist even when the compressed air reaches the region of the swirler opening, and a free vortex of the compressed air is created at the inlet of the swirler opening, causing static pressure drop at the inlet.

When the free vortex is strong, the static pressure drop sometimes reaches a degree such that the static pressure at the upstream side of the swirler opening is lower than that at the downstream side of the same. This means that a reverse flow occurs from within the combustion chamber to the upstream side of the swirler opening. It is apparent that this phenomenon is not desirable for combustion.

Furthermore, the compressed air from the compressor sometimes enters the annular passage in non-uniformly distributed or localized condition. This is also not desirable for reasons set out hereinafter in detail.

SUMMARY OF THE INVENTION

It is the main object of this invention to provide an improved combustor device for a gas turbine engine, which can eliminate or reduce the swirling motion of the compressed air and the resultant static pressure drop at the inlet of the swirler opening, thus ensuring optimum combustion in the combustor device.

Another object of this invention is to provide an improved combustor device of the above stated character wherein nonuniform distribution of the supplied air can be eliminated or reduced.

According to the improvement of this invention, a number of swirl preventing vanes are securely provided in the space between the outer and inner casings of the combustor device. These vanes have shapes and dispositions to eliminate or reduce swirling motion of the compressed air around the swirler opening and prevent static pressure drop of the compressed air at the inlet of the swirler opening.

According to another feature of this invention, guide vanes are fixedly provided around the outer cylindrical surface of the inner casing near the upstream end of the annular passage between the outer and inner casings. These guide vanes have sloping guide surfaces, respectively, for causing the compressed air from the compressor to flow with circumferentially swirling motion.

The invention will be more clearly understood from the following detailed description of the invention when read in conjunction with the accompanying drawings, wherein like parts are designated by like reference numerals.

BRIEF DESCRIPTION OF THE DRAWINGS

In the drawings:

FIG. 3 is a longitudinal section, on an enlarged scale, of the combustor device shown in FIG. 1;

FIG. 4 is a cross section taken along the line IV—IV in FIG. 3;

FIG. 5 is a schematic view explanatory of the shape and disposition of swirl preventing vanes used in the device shown in FIG. 3;

FIG. 6 is a fragmentary longitudinal section showing a modified combustor device according to this invention;

FIG. 7 is a longitudinal section of the combustor device shown in FIG. 3, further having guide vanes for imparting swirling motion to the compressed air;

FIG. 8 is a cross section taken along the line VIII—VIII in FIG. 7;

FIG. 9 is a longitudinal section of still another modified form of the combustor device according to this invention;

DETAILED DESCRIPTION

Figure 1:
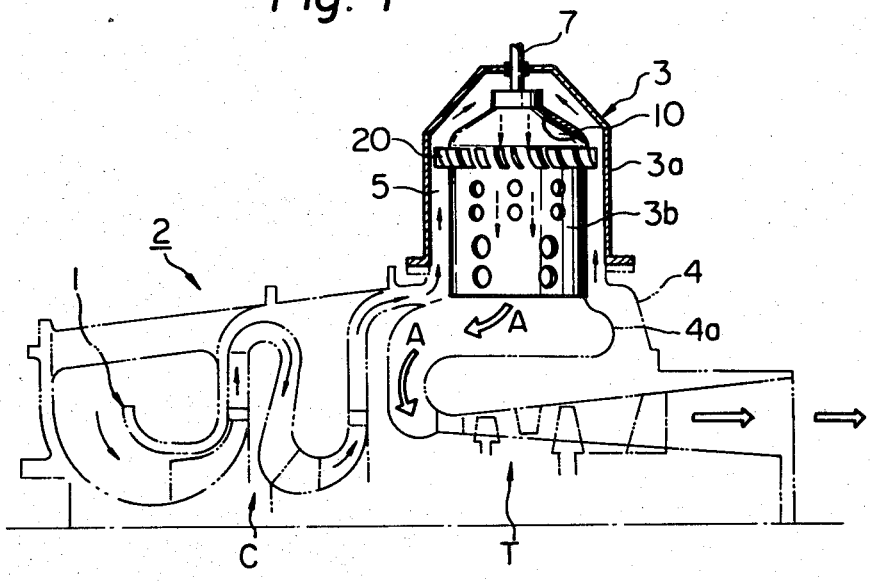
FIG. 1 is a schematic view showing a gas turbine engine in which a combustor device according to this invention is used.

Referring to FIG. 1, there is schematically illustrated a gas turbine engine 2 provided with a combustor device 3 according to this invention. As is well known in the art, the gas turbine engine 2 comprises a compressor C having an air inlet 1, and a turbine T. Air sucked into the compressor C through the inlet 1 is subjected to compression, and the air compressed therein is then sent into the combustor device 3, in which fuel is injected into the air and ignited and combustion takes place, as will be described in more detail hereinafter. The combustion gas produced in the combustor device 3 then flows as indicated by arrow marks A into the turbine T to drive the same.

The combustor device 3 is fixedly mounted on a turbine scroll casing 4, and comprises a cylindrical outer casing 3*a* and a cylindrical inner casing 3*b* coaxially disposed in the outer casing 3*a* to define therebetween an annular passage 5 for the intake of compressed air discharged from the compressor C. The inner casing 3*b* defines therein a combustion chamber 10 into which fuel is injected. The upwardly flowing air in the annular passage 5 flows through a swirler opening at the top of the inner casing 3*b* into the latter and is subjected to combustion as above described.

Figure 2:
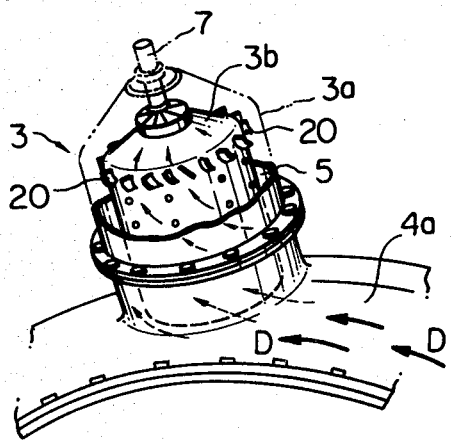
FIG. 2 is a fragmentary perspective view, partly broken away, showing the combustor device of FIG. 1 in relation to a turbine scroll.

As shown in FIG. 2, the combustion device 3 is often installed on the turbine scroll 4*a* at an off-center position offset with respect to the central part of the turbine scroll for reasons of design. In the case shown in FIG. 2, for example, the combustor device 3 is located at a position rearwardly offset from the turbine scroll middle part, and the compressed air flows as indicated at D because of the rotation of the compressor blades. As a consequence, the compressed air D from the compressor C flows into the annular passage 5 of the combustor device 3 with tangential velocity components. More specifically, the compressed air D enters the annular passage with a left-handed swirling motion as viewed in FIG. 2 or a counterclockwise helical flow as viewed in the axial advance direction. This is not desirable for reasons described hereinafter.

Referring now to FIGS. 3 and 4, the combustor device 3 is shown in more detail. The outer casing 3*a* is closed at the top by a top wall 6 through which a fuel injector pipe 7 extends downward. At the top of the inner casing 3*b*, a swirler opening 8 is provided which has a plurality of air inlets defined by circumferentially spaced apart radial swirler vanes 9 functioning to impart a swirling motion to the compressed air flowing downward from within the space between the top wall 6 and the swirler opening 8 into the combustion chamber 10 in the inner casing 3*b*. The swirler vanes 9 are secured between an outer flange 11 on the inner casing 3*b* and an inner ring 12. The fuel injector pipe 7 operates to inject fuel into the combustion chamber 10. An ignition plug 14 is provided on the wall of the inner casing 3*b* for the ignition of the fuel injected into the chamber 10. The inner casing 3*b* is formed with a number of secondary air supply openings 15 and a number of dilution air supply openings 16.

In the operation of the combustor device 3, the compressed air D flows into the annular passage 5 with tangential velocity components as described above so that the air in the passage 5 flows spirally with a swirling motion as indicated at 18. When this occurs, a free vortex of air is formed above and around the swirler opening 8. As a result, the static pressure directly above the swirler opening 8 is considerably reduced, and if the free vortex is too strong, the air above the opening 8 is prevented from entering the combustion chamber 10. In the worst case the combustion gas in the chamber 10 flows back upward through the opening 8, so that the durability of the device is considerably impaired. It will be understood that when air is prevented from flowing downward through the swirler opening 8, shortage of air in the primary combustion zone in the combustion chamber 10 occurs with resultant richness of the amount of fuel, so that the combustion flame becomes unnecessarily long with resultant production of smoke and damages the associated parts.

In order to obviate the above described undesirable phenomena, swirl preventing vanes are provided in a manner to reduce or eliminate the swirling motion of air in the annular passage 5, according to this invention. The vanes for reducing or eliminating the swirling motion are designated by reference numeral 20 in FIGS. 3 and 4. The shape of the swirl preventing vanes 20 is schematically shown in FIG. 5. It will be noted that each vane 20 comprises a curved body consisting of a lower or upstream tangentially sloping portion 20*a* and an upper or downstream axially extending portion 20*b*, whereby the air flow 18 with tangential velocity components is converted into upwardly directed flow 18*a*. The thus upwardly directed flow of air then reaches the space above the swirler opening 8 without any or with substantially no tangential velocity components, so that substantially no free vortex of air exists above and around the swirler opening 8 and the static pressure above the opening 8 rises accordingly. It will thus be understood that the swirl preventing vanes 20 serve to convert part of the velocity head of the air flow 18 into a static pressure head.

The static pressure rise is attained also owing to the fact that the cross-sectional dimension X (FIG. 5) of each interspace between the adjoining swirl preventing vanes 20 at the lower or inlet side is smaller than the cross-sectional dimension Y of the interspace at the upper or outlet side, whereby the air velocity is caused to decrease while air is flowing through the interspace and part of the velocity head is converted into a static pressure head.

The swirl preventing vanes 20 are shown as rigidly secured to the outer surface of the inner casing 3*b*, but they may be secured to the inner surface of the outer casing 3*a* as well.

In the embodiment of the invention shown in FIG. 3, the swirl preventing vanes 20 are disposed at the upper part of the inner casing 3*b*. However, the position of these vanes 20 may be at the lower part of the casing 3*b*, as shown in FIG. 6. In this modified form, the swirling motion of the compressed air D is eliminated or reduced when the air passes through the vanes 20, and in the annular passage 5 above the vanes 20, the upwardly flowing air no longer has swirling motion.

The shape of the swirl preventing vanes 20 shown in FIG. 5 may be horizontally reversed. In this case also, the swirling motion can be eliminated or reduced. However, since the lower sloping portion 20*a* of each vane is directed in a direction different from the direction of the swirling air flow, pressure loss tends to occur in this modification.

As was previously described with reference to FIG. 2, the velocity components of the compressed air in tangential directions with respect to the turbine scroll and the offset or off-center disposition of the combustor device 3 cause swirling motion of the compressed air entering the annular passage 5. On the other hand, the off-center or offset disposition of the combustor device 3 with respect to the turbine scroll 4 sometimes gives rise to non-uniform distribution of the compressed air D circumferentially of the annular passage 5, rather than to the swirling motion. More specifically, at some circumferential portion of the annular passage 5 the flowrate and velocity of the compressed air D flowing inwardly of the passage 5 are greater than those at other circumferential portion. If such non-uniform distribution of the compressed air occurs in the annular passage 5, shearing forces are exerted between adjoining strong and weak flows of the air D and this causes eddy current to be produced in the annular passage 5 with resultant non-uniformity of fresh air being supplied in the combustion chamber 10.

This is not desirable because the non-uniformity of fresh air supplied causes non-uniformity of combustion and hence localized temperature rise which may cause damage to the inner casing 3*b*. Moreover, when compressed air flow in the annular passage 5 is too strong at some part therein, it flows upward over the swirler opening 8 and then flows down against upwardly flowing weak flow in the annular passage 5, so that eddy currents of air are produced in the passage 5 and they also cause non-uniform combustion in the chamber 10.

When the above stated phenomena of non-uniform supply of air are prominent as compared with the occurence of the swirling motion, the combustor device 3 shown in FIGS. 7 and 8 may be used. The combustor device shown in FIGS. 7 and 8 differs from that shown in FIG. 3 only in that guide vanes 25 are provided along the lower periphery of the inner casing 3*b*. These guide vanes 25 may be secured either to the inner casing 3*b* or the outer casing 3*a*. The function of the guide vanes 25 is to impart a swirling motion to the compressed air D. For this purpose, each guide vane 25 has a gradually tangentially curved guide surface as shown.

Flow of the compressed air D entering the annular passage 5 with circumferentially non-uniform distribution is first acted upon by the guide vanes 25 and given a swirling motion after it has passed through the vanes 25. The swirling air flow 26 in the annular passage 5 then passes through the swirl preventing vanes 20 identical to the vanes 20 shown in FIG. 3 and is converted into an axial flow substantially without swirling motion whereby substantially no static pressure drop occurs in the space above the swirler opening 8 for the reasons described previously hereinbefore.

It is to be noted that the swirling motion imparted to the compressed air D intentionally by means of the guide vanes 25 is effective to eliminate or reduce the non-uniformity of the compressed air supply into the annular passage 5. When air is imparted swirling motion, it is caused to flow a through distance longer than the distance through which the air would flow axially without tangential velocity components. It will be understood that during the longer travel, adjoining strong and weak air flows will be influenced by each other and will be intermixed into a uniformly distributed flow. The thus uniformly distributed air flow is then subjected to the swirl preventing action of the vanes 20. It will also be understood that when a suitable degree of swirling motion of the air D exists before it enters the annular passage 5, the guide vanes 25 need not necessarily be provided. Non-uniformity of air flow distribution will in this case be reduced by the swirling motion existing from the beginning.

Figure 10:
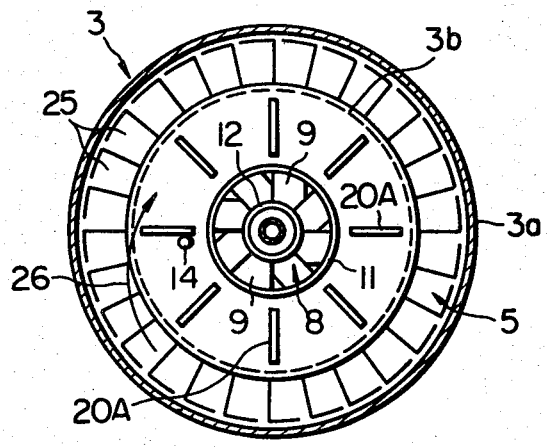
FIG. 10 is a cross section taken along the line X—X in FIG. 9.

FIGS. 9 and 10 illustrate a modification of the combustor device 3 shown in FIGS. 7 and 8. In this modification, the swirl preventing vanes are in the form of a number of radially extending vertical vanes 20A provided on the top wall of the inner casing 3*b* and circumferentially spaced apart equidistantly. It will be understood that the swirling air flow 26 is prevented from making further swirling motion upon being intercepted by the vanes 20A. It is to be noted that the guide vanes 25 at the inlet of the annular passage 5 need not necessarily be provided in the case where the compressed air D has a swirling motion from the beginning. In this modification, the swirl preventing vanes 20A are planar vanes but they may be suitably curved, if desired. In any case, the swirling motion of the air flow 26 is at least reduced by the vanes 20A, and static pressure drop above the swirler opening 8 is realized to obtain optimum combustion in the combustion chamber 10.

Figure 11:
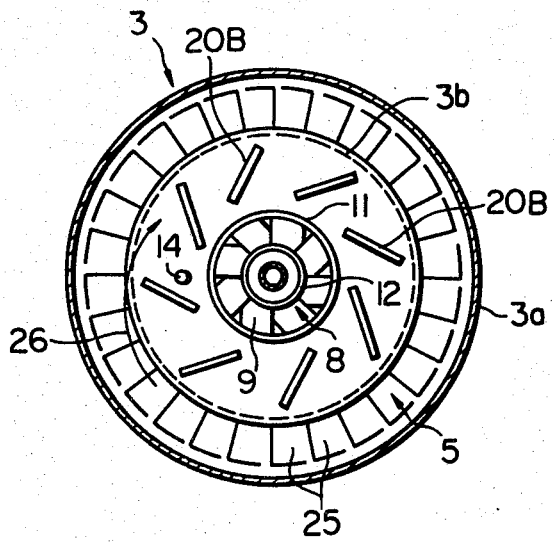
FIG. 11 is a cross section similar to FIG. 10, but showing a combustor device with modified swirl preventing vanes.

In a further modification shown in FIG. 11, the swirl preventing vanes are in the form of a number of vertical vanes 20B provided on the top of the inner casing 3*b* in circumferentially equidistantly spaced apart relationship and each extending in a direction at an angle with respect to a radius of the combustor device 3. Again, each vane 20B may be curved instead of being planar. In any case, each vane 20B should be oriented to intercept the swirling air flow 26 in a manner to reduce the swirling motion thereof.

We claim:

1. In a combustor device for a gas turbine engine having a compressor for supplying compressed air into the combustor device and a turbine driven by combustion gas from the combustor device, said combustor device comprising a cylindrical outer casing having a closed axial end and an open axial end, a cylindrical inner casing coaxially provided in the outer casing to define between the outer and inner casings an annular passage for taking therein the compressed air from the compressor, said inner casing defining therein a combustion chamber and having in one axial end thereof facing the closed axial end of the outer casing a swirler opening which is coaxial with said outer and inner casings and through which the compressed air in the annular passage flows into the combustion chamber, said outer and inner casings being disposed in such a manner that the common axis of the casings extends substantially transverse to the rotational axis of the turbine, and fuel injection means for injecting fuel into the combustion chamber:

the improvement comprising a number of swirl preventing vanes fixedly provided in the space between said outer and inner casings, each of said swirl preventing vanes having a tangentially sloping upstream portion and an axially extending downstream portion to eliminate or reduce swirling motion of the compressed air around said swirler opening thereby to prevent static pressure drop of the compressed air at the inlet of the swirling opening.

2. The improvement according to claim 1 wherein said swirl preventing vanes are vanes fixedly attached around the outer cylindrical surface of the inner casing.

3. The improvement according to claim 2 wherein said swirl preventing vanes are disposed near the downstream end of said annular passage.

4. The improvement according to claim 2 wherein said swirl preventing vanes are disposed near the upstream end of

5. The improvement according to claim 1 wherein said swirl preventing vanes are vanes fixedly provided around said swirler opening and extending radially in circumferentially equidistantly spaced apart relationship to intercept swirling compressed air flow.

6. In a combustor device for a gas turbine engine having an compressor for supplying compressed air into the combustor device and a turbine driven by combustion gas from the combustor device, said combustor device comprising a cylindrical outer casing having a closed axial end and an open axial end, a cylindrical inner casing coaxially provided in the outer casing to define between the outer and inner casings an annular passage for taking therein the compressed air from the compressor, said inner casing defining therein a combustion chamber and having in one axial end thereof facing the closed axial end of the outer casing a swirler opening through which the compressed air in the annular passage flows into the combusion chamber, and fuel injection means for injecting fuel into the combustion chamber:

the improvement comprising a number of swirl preventing vanes fixedly provided in the space between said outer and inner casings near the downstream end of said annular passage, said swirl preventing vanes having shapes and dispositions to eliminate or reduce swirling motion of the compressed air around said swirler opening thereby to prevent static pressure drop of the compressed air at the inlet of the swirler opening, and guide vanes fixedly provided around the outer cylindrical surface of the inner casing near the upstream end of said annular passage, said guide vanes having respective sloping guide surfaces for causing the compressed air from the compressor to flow with circumferentially swirling motion.

7. In a combustor device for a gas turbine engine having a compressor for supplying compressed air into the combustor device and a turbine driven by combustion gas from the combustor device, said combustor device comprising a cylindrical outer casing having a closed axial end and an open axial end, a cylindrical inner casing coaxially provided in the outer casing to define between the outer and inner casings an annular passage for taking therein the compressed air from the compressor, said inner casing defining therein a combustion chamber and having in one axial end thereof facing the closed axial end of the outer casing a swirler opening which is coaxial with said outer and inner casings and through which the compressed air in the annular passage flows into the combustion chamber, said outer and inner casings being disposed in such a manner that the common axis of the casings extends substantially transverse to the rotational axis of the turbine, and fuel injection means for injecting fuel into the combustion chamber:

the improvement comprising a number of swirl preventing vanes fixedly provided in the space between said outer and inner casings and having shapes and dispositions to eliminate or reduce swirling motion of the compressed air around said swirler opening thereby to prevent static pressure drop of the compressed air at the inlet of the swirler openings, said swirl preventing vanes being vanes fixedly provided around said swirler opening and each extending in a direction at an angle to a radius of the inner casing to intercept swirling compressed air flow.

8. In a combustor device for a gas turbine engine having a compressor for supplying compressed air into the combustor device and a turbine driven by combustion gas from the combustor device, said combustor device comprising a cylindrical outer casing having a closed axial end and an open axial end, a cylindrical inner casing coaxially provided in the outer casing to define between the outer and inner casings an annular passage for taking therein the compressed air from the compressor, said inner defining therein a combustion chamber and having in one axial end thereof facing the closed axial end of the outer casing a swirler opening which is coaxial with said outer and inner casings and through which the compressed air in the annular passage flows into the combustion chamber, said outer and inner casings being disposed in such a manner that the common axis of the casings extends substantially transverse to the rotational axis of the turbine, and fuel injection means for injecting fuel into the combustion chamber:

the improvement comprising a number of swirl preventing vanes fixedly provided in the space between said outer and inner casings and having shapes and dispositions to eliminate or reduce swirling motion of the compressed air around said swirler opening thereby to prevent static pressure drop of the compressed air at the inlet of the swirler openings, said swirl preventing vanes being disposed near the upstream end of said annular passage, each of said swirl preventing vanes having a tangentially sloping upstream portion and an axially extending downstream portion, the upstream and downstream portions of adjoining vanes forming therebetween upstream and downstream interspaces for flow of compressed air, respectively, the cross-sectional dimension of the downstream interspace being greater than that of the upstream interspace whereby the velocity head of the compressed air is partly converted into a static pressure head as the compressed air flows through the interspaces.

* * * * *